United States Patent [19]

Hill et al.

[11] 4,320,599

[45] Mar. 23, 1982

[54] POLISHER-FINER APPARATUS

[75] Inventors: Phillip Hill; Billy D. Hunter, both of Muskogee, Okla.

[73] Assignee: Coburn Optical Industries, Inc., Muskogee, Okla.

[21] Appl. No.: 162,557

[22] Filed: Jun. 24, 1980

[51] Int. Cl.[3] ..... B24B 7/00

[52] U.S. Cl. ..... 51/58; 51/157

[58] Field of Search ..... 51/54, 55, 58, 284, 51/157

[56] References Cited

U.S. PATENT DOCUMENTS 2,381,449 8/1945 Holman ..... 51/55

3,732,647 5/1973 Stith ..... 51/55

4,135,333 1/1979 Stith ..... 51/58

4,277,915 7/1981 Hausermann ..... 51/58

*Primary Examiner*—Harold D. Whitehead

*Attorney, Agent, or Firm*—John J. Byrne

[57] ABSTRACT

An apparatus for finishing toric surfaces of ophthalmic lenses. The apparatus includes a frame and a first assembly for providing an orbital, break-up motion to a lapping tool having a polishing surface of a selected base curve and cross curve. A second assembly is also mounted upon the frame for providing an orbital, break-up motion to a lens to be finished. Adjustment means are provided for selectively adjusting the amplitude of the orbital, break-up motion of both the lapping tool and the lens.

13 Claims, 11 Drawing Figures

FIG. 5
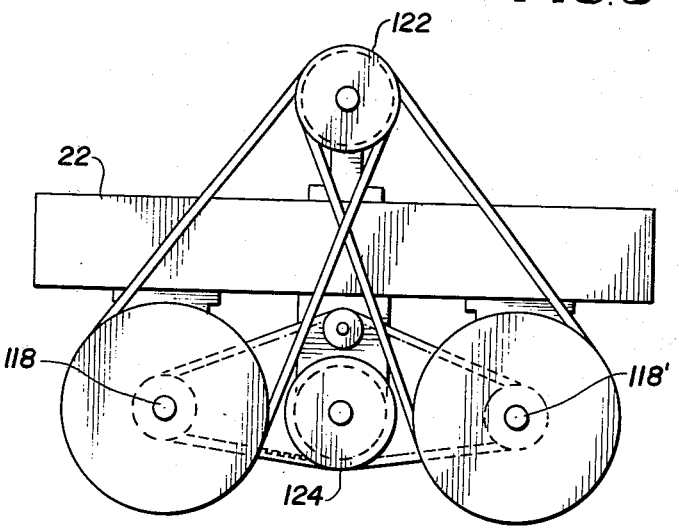
FIG. 7
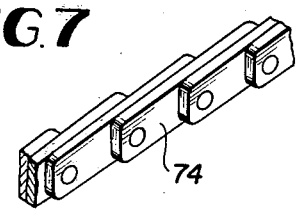
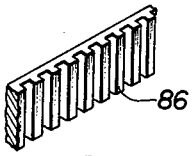
FIG. 8
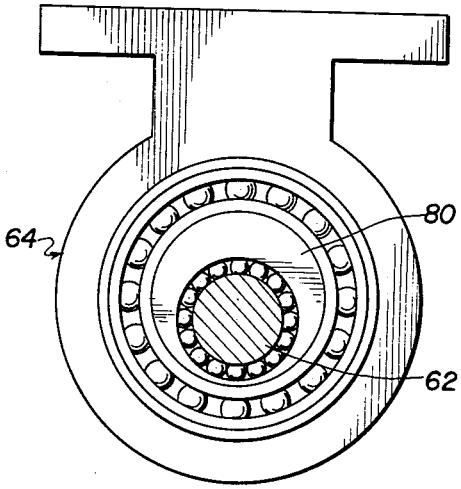
FIG. 6

POLISHER-FINER APPARATUS

BACKGROUND OF THE INVENTION

This invention relates to an apparatus for finishing lenses. More specifically, this invention related to an apparatus for polishing or fining toric surfaces of ophthalmic lenses. In ophthalmic lens finishing, the terms "polish" and "fine" are terms of art indicating a degree of finish achieved. Since the subject apparatus is used for both polishing and fining the terms will be used interchangeably.

In ophthalmic optics, lens blanks are formed from glass or plastic and a convex surface of the lens is mounted upon a retaining member known as a lens block. The lens and block are then accurately mounted upon a grinding apparatus wherein a torodial surface of compound prescriptive value is rough ground into a concave portion of the lens. In this regard a first principal meridian of the lens typically has a different dimension than a second principal meridian normal to the first. Following the initial grinding operation, an ophthalmic lens is fined and then polished to a final prescriptive value. Left and right lenses are then mounted upon an edge grinding machine to cut the outer peripheral shape required to be compatible with an ultimate wearers eye glass frame.

The subject invention is directed to a polisher-finer apparatus and comprises an improvement over a Stith U.S. Pat. No. 3,732,647 of common assignment with the subject application. More specifically, the Stith patent discloses a polisher-finer wherein the lens is finished by being biased into a lapping tool having a toric surface of the final desired prescriptive value. The lapping tool is driven in an orbital, break-up motion relative to the lens to prevent ridges, grooves and/or other aberrations from forming in the lens surface which might occur if regular or uniform motion devices were utilized. In addition to orbital, break-up motion of the lapping tool the Stith patent discloses moving the lens in a transverse motion from side-to-side. In at least one other system, front to rear motion is added to the transverse motion of the lens to be finished.

Although polisher-finer systems of the type previously described have been widely utilized, room for significant improvement remains. In this regard, it would be desirable to increase the relative speed of motion between the lapping tool and lens without sacrificing any of the system finishing ability. Still further it would be desirable to be able to facilely vary the amplitude of the orbital, break-up motion of the apparatus.

OBJECTS OF THE INVENTION

It is therefore a general object of the invention to provide a novel apparatus for finishing ophthalmic lenses which will advantageously achieve desirable characteristics of the type previously described.

It is a particular object of the invention to enhance the speed in which toric lens surfaces may be finished.

It is a related object of the invention to decrease lens finishing time without increasing the orbital, break-up speed of the lens lapping tool.

It is another object of the invention to provide a novel apparatus wherein the amplitude of orbital, break-up motion of a lens finishing apparatus may be facilely adjusted.

It is a further object of the invention to provide a novel lens finishing apparatus wherein the relative finishing motion between a lens lapping tool and a lens may be enhanced.

BRIEF SUMMARY OF THE INVENTION

A preferred embodiment of the invention which is intended to accomplish at least some of the foregoing objects comprises a lens finishing apparatus having a first gimbal mounted assembly for providing an orbital, break-up motion to a lens lapping tool. The subject finishing apparatus further includes a second gimbal mounted assembly for providing an orbital, break-up motion to a lens to be finished. In combination the first and second gimbal mounted assemblies produce a dual orbital, break-up motion between a toric lens and a lapping tool. First and second adjustment assemblies are connected to the first and second gimbal mounted members for selectively varying the amplitude of the orbital, break-up motions.

THE DRAWINGS

Other objects and advantages of the present invention will become apparent from the following detailed description of a preferred embodiment thereof taken in conjunction with the accompanying drawings, wherein:

FIG. 5 is a top view of the subject apparatus;

FIG. 6 is a cross-sectional view taken along section line 6—6 in FIG. 3 and discloses a first eccentric mounting assembly;

FIG. 7 is an axonometric view of one form of flexible belt used with the subject apparatus;

FIG. 8 is an axonometric view of another form of belt used with the subject apparatus;

DETAILED DESCRIPTION

Figure 1:
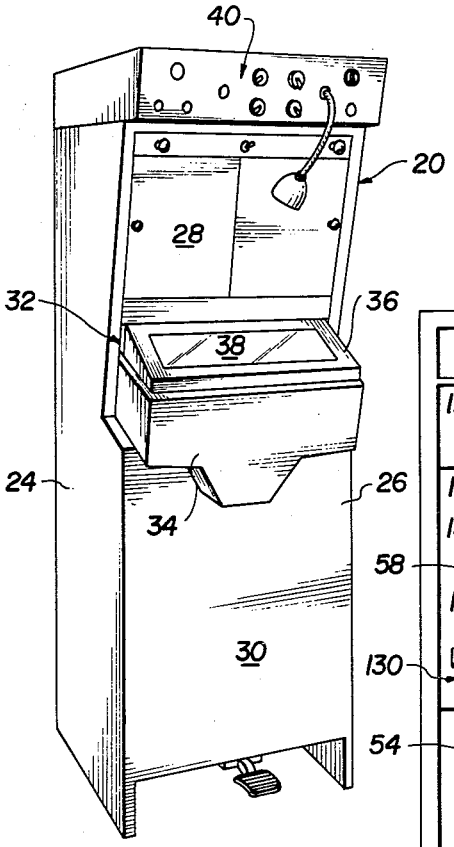
FIG. 1 is an axonometric view of an apparatus for finishing ophthalmic lenses in accordance with a preferred embodiment of the invention.

Referring now to the drawings, wherein like numberal indicate like parts, and particularly FIG. 1 thereof, there will be seen an axonometric view of a polisher-finer apparatus 20 in accordance with a preferred embodiment of the invention.

Before providing a detailed description of the subject structural system it may be worthwhile to briefly outline the context of the instant invention. In this connection, the polisher-finer apparatus 20 includes a generally upright frame 22, note FIG. 2, which supports left and right side walls 24 and 26 respectively as well as upper 28 and lower 30 front cabinet members. A working enclosure 32 is mounted at a generally mid point of the apparatus and includes a catch basis 34 and a lid 36 having a transparent window 38.

The apparatus is provided with a closed loop fluid system, an air pressure system and an electrical system (not shown). These systems are controlled and monitored by an array of guages and control switches 40 which are within the purview of one skilled in the art.

Figure 2:
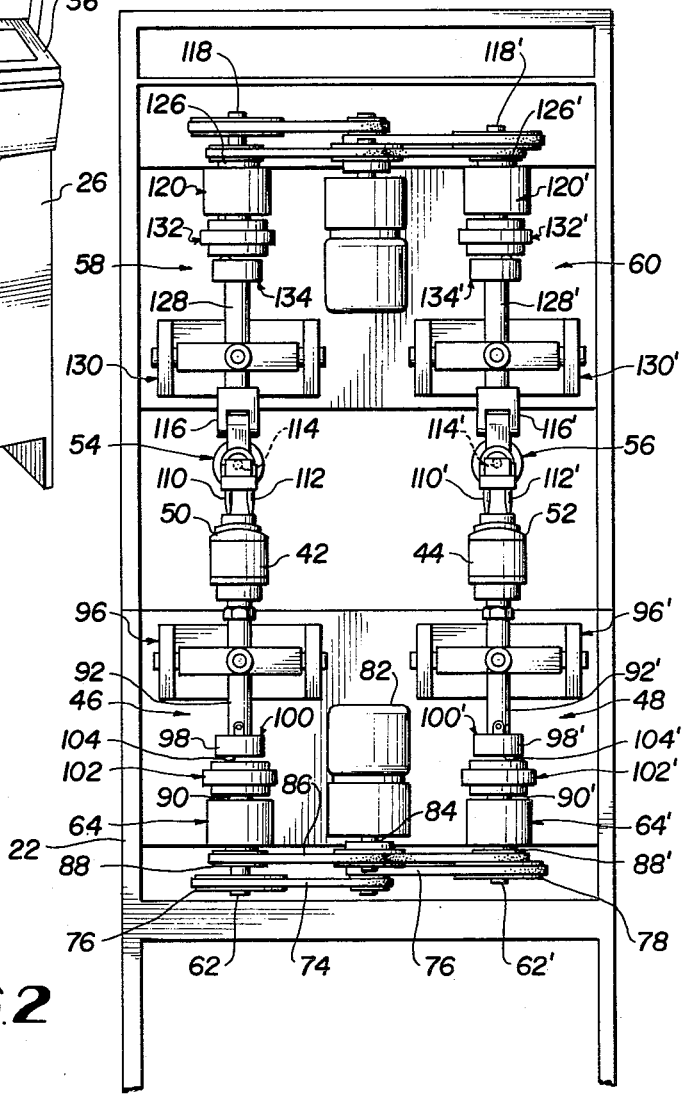
FIG. 2 is a front view of the apparatus depicted in FIG. 1 with the front housing elements removed to disclose dual break-up motion assemblies mounted above and below lens to be finished.

In brief operation, an operator desiring to finish ophthalmic lenses lifts the cover 36 and inserts lapping tools 42 and 44, note FIG. 2, onto left and right orbital, break-up assemblies 46 and 48. The lapping tools are selected to have a convex toric configuration compatible with the shape of the lenses to be finished.

Figure 3:
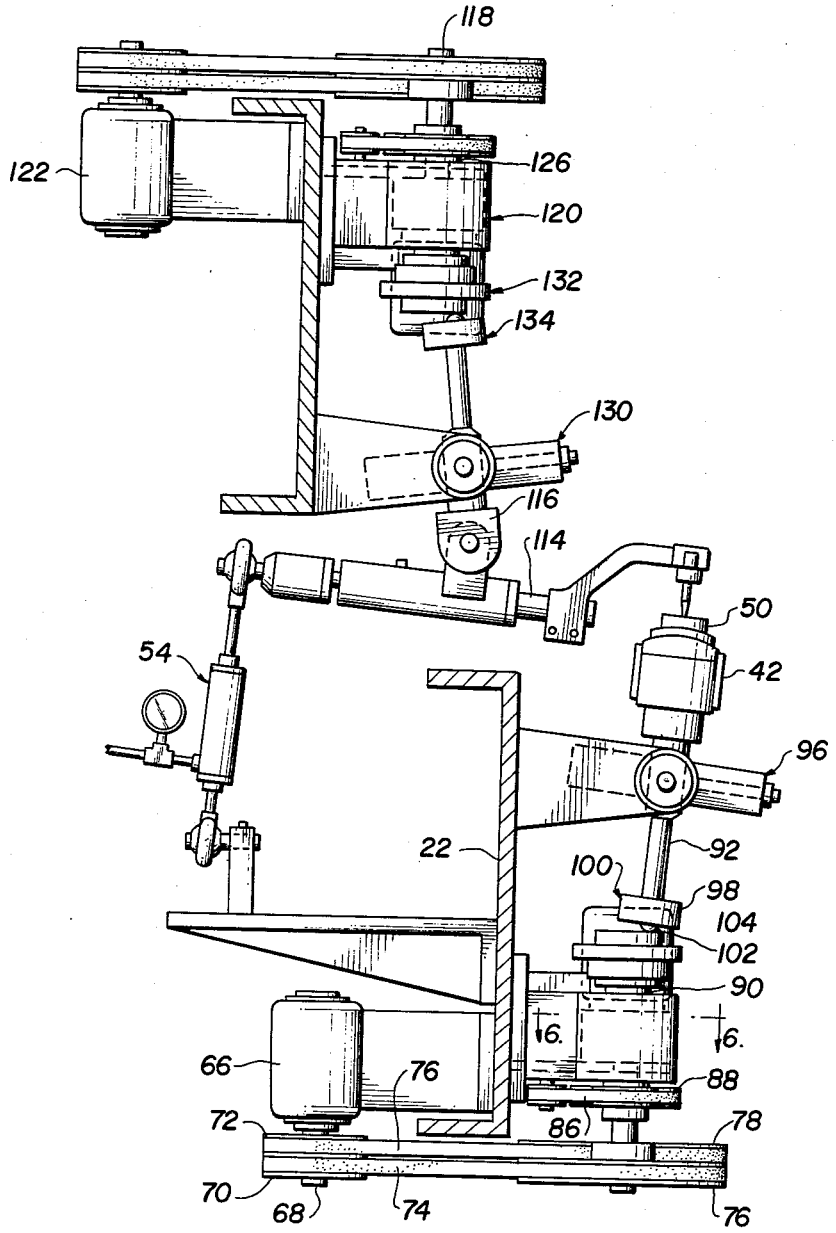
FIG. 3 is a side elevational view of the subject apparatus wherein one set of upper and lower break-up motion assemblies are particularly illustrated.
Figure 4:
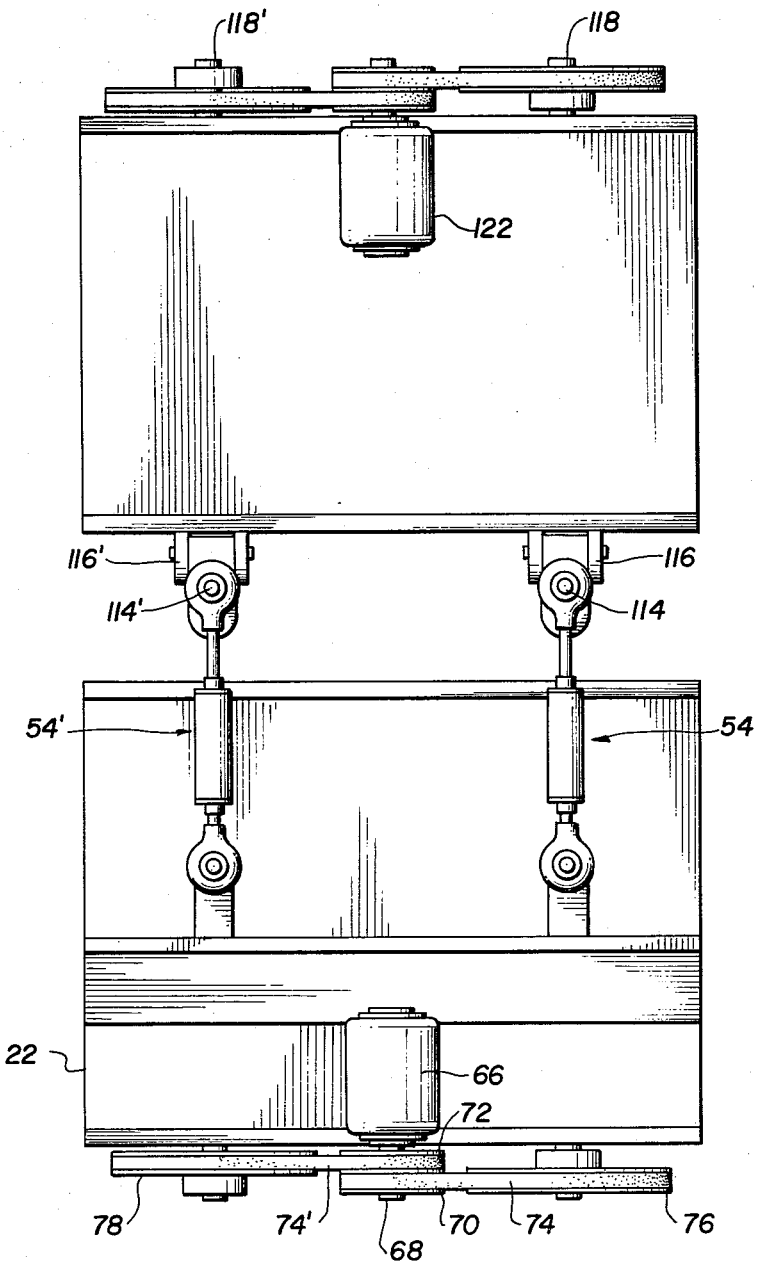
FIG. 4 is a back view of the apparatus depicted in FIGS. 1–3.

Left 50 and right 52 blocked lenses are then positioned upon the lapping surface of the tools 42 and 44 respectively and are biased against the lapping tools by the provision of air pressure biasing assemblies 54 and 56, note FIGS. 2 and 3. The biasing assemblies in turn are suspended by left and right orbital, break-up assemblies 58 and 60.

Lens finishing (i.e. polishing and/or fining) is then achieved by producing relative orbital, break-up motion between the lenses 50 and 52 and associated lapping tools 42 and 44 respectively. The working surfaces of the tools are continuously drenched within the working enclosure 32 with a fine abrasive fluid from a closed loop fluidic system as previously mentioned.

Dual, Orbital, Break-up Structure

Referring now to FIGS. 2–8, there will be seen various detailed views of dual, orbital, break-up assemblies, in accordance with a preferred embodiment of the invention.

The orbital, break-up motion assemblies 46 and 48 are mounted upon a lower portion of the frame 22 and are identical in function and structure. Accordingly, only unit 46 will be described in detail with corresponding elements of the unit on the right indicated by the same numeral with the addition of a prime mark.

The orbital, break-up assembly 46 includes a first shaft 62 which is journaled through an eccentric bearing assembly 64, note sheet 6, mounted upon frame 22. An electric motor 66 is also connected to a lower portion of the frame and includes a downwardly extending output shaft 68 to which a pair of pulleys 70 and 72 are mounted. A flexible belt 74, note also FIG. 7, connects pulley 70 to a pulley 76 mounted upon the lower end of shaft 62. A similar flexible belt 76 connects pulley 72 to a pulley 78 mounted upon the lower end of shaft 62'. Accordingly, the motor 66 served to rotate shafts 62 and 62' within the eccentric bearings 64 and 64'.

The bearings 64 and 74', as noted in FIG. 6, include a cylindrical eccentric 80. The eccentric is rotated within the bearing assembly 64 by the provision of a second electric motor 82 having a downwardly extending drive shaft and pulley 84 and a synchronous drive belt 86, note FIG. 8, which passes around pulleys 88 and 88' connected to the eccentric.

As will be appreciated, the upper ends 90, 90' of the first shafts 62, 62' exhibit a rotational motion about their axes and a circular motion upon the periphery of an imaginery cylinder from the motion of eccentrics 80, 80'. In practice, the shafts 62, 62' are rotated must faster than the eccentrics 80, 80' and in combination impart a dual motion to the upper end of the first shafts 62, 62'.

Each orbital, break-up assembly 46 and 48 further includes a second shaft 92, 92' which projects at the uppermost ends thereof into the working enclosure 32 and serves to carry lapping tools 42, 44 respectively having a pre-selected toric curvature.

The second shafts 92, 92' extend through generally horizontal gimbal mounting assemblies 96, 96' which are mounted upon a lower portion of frame 22.

The lowermost portion of the shafts 92, 92' are fitted with the socket portion 98, 98' of universal ball joints 100, 100'. Adjustment assemblies 102, 102' which will be discussed in detail below, carring balls 104, 104' interconnect the first shafts 62, 62' with the second shafts 92, 92'. The rotational and orbital motion of the first shafts are thus imparted to the second shafts 92, 92' which are prevented from rotation by the gimbal assemblies. The resultant motion of the lapping tools 42 and 44 may be characterized as an orbital break-up motion wherein the primary meridian of the lapping tool toric surface do not rotate. In order to effectuate the foregoing motions it will be appreciated by those skilled in the art that a degree of axial play is built into the connection assemblies and/or an axial slip joint is incorporated into the shafts as desired.

As previously indicated left 50 and right 52 blocked lenses are positioned upon the upper surface of the lapping tools 42 and 44. The lenses are continuously biased into engagement with the lapping tools by left and right air cylinder assemblies 54 and 56 respectively. Left 110 and right 112 prongs extend downwardly from each air cylinder assembly and fits into spaced recesses formed within the back surface of the lens blocks. Horizontal arms 114, 114' of the air pressure biasing assemblies 54 and 56 are supported by pivot brackets 116, 116' carried by the left and right orbital, break-up assemblies 58 and 60.

Assemblies 58 and 60 comprises elements common with and are similar in structure and function to the orbital, break-up assemblies 46 and 48. Accordingly a detailed description of these assemblies are incorporated by reference by referring again to the description of assemblies 46 and 48. Briefly, however, assemblies 58 and 60 include first generally vertical shafts 118, 118' which are journaled through eccentric bearing assemblies 120, 120' such as previously illustrated in connection with FIG. 6.

An electric motor 122 drives shafts 118, 118' while electric motor 124 drives eccentrics 126, 126' to produce a resultant rotational and orbital motion to the lower end of shafts 118, 118'. The assemblies 58 and 60 also include second shafts 128, 128' which extend through gimbal mounting assemblies 130, 130'. The first and second shafts are interconnected through amplitude adjustment assemblies 132, 132' and ball joint assemblies 134, 134' in a manner previously discussed in connection with orbital break-up assemblies 46 and 48.

In accordance with the foregoing, pivot brackets 116, 116' and accordingly lenses 50 and 52 will exhibit an orbital, break-up motion relative to the lapping tools wherein the base and cross curves do not rotate but remain parallel with the base curve and cross curve of the lapping tool during the entire lens finishing operation.

Adjustment Mechanism

Figure 9:
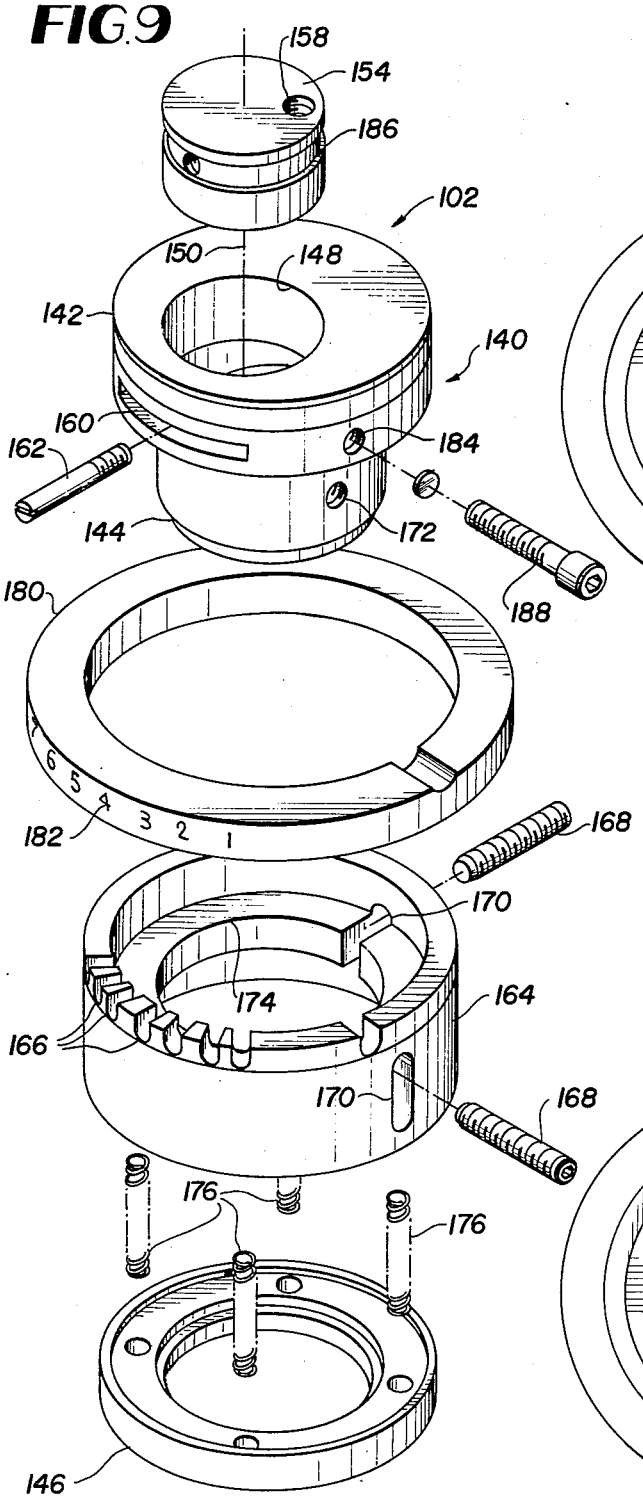
FIG. 9 is an exploded axonometric view of a second eccentric mounting assembly wherein the eccentricity may be facilely adjusted as desired.
Figure 10:
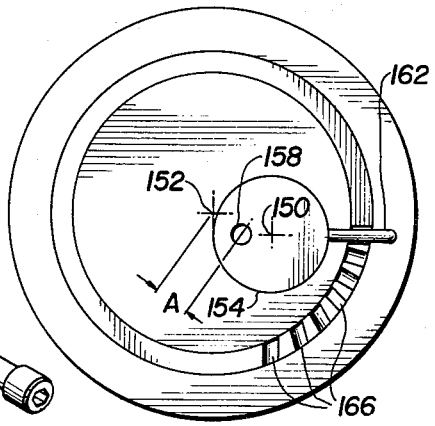
FIG. 10 is a schematic cross-sectional view of the adjustable eccentric in one extreme position.
Figure 11:
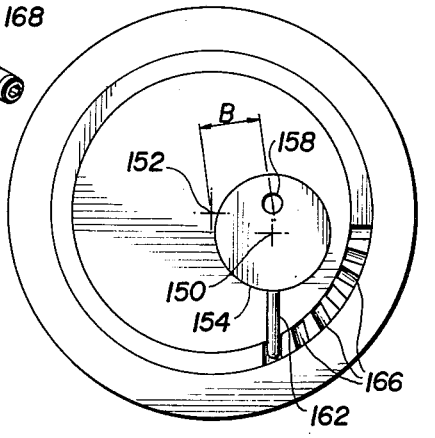
FIG. 11 is a schematic cross-sectional view of the adjustable eccentric, similar to FIG. 10 but in the other extreme position of adjustment.

Referring now to FIGS. 9–11 there will be seen an eccentric adjustment assembly 102 for adjusting the amphitude of orbital, break-up motion of the unit apparatus in accordance with a preferred embodiment of the invention.

More specifically, the adjustment member includes a base member 140 comprising a generally solid cylindrical member having a radially enlarged head portion 142 at one end thereof. The other end 144 of the cylindrical member fits securely within a mounting ring 146 which may be fixedly connected to the free end of shaft 62, note FIGS. 2 and 3. Accordingly, the cylindrical base member 140 will follow the rotating orbital motion of the shaft 62.

The free end of the radially enlarged head portion 142 is fashioned with a cylindrical recess 148 having a central longitudinal axis 150 which is radially offset from the central longitudinal axis 152 of the base member 140. An eccentric member 154 comprising a generally solid cylindrical plug is dimensioned to be coaxially received within recess 148. An upper surface of the eccentric member 154 has a threaded recess 158 to receive a threaded mounting for a ball 104 of a universal ball joint 100, note FIG. 3. As can be seen in FIGS. 10 and 11, the ball mounting recess 158 is radially offset from the central pivotal axis of the eccentric 154 such that rotation of said eccentric will serve to vary the distance the ball mounting is offset with respect to the central longitudinal axis 152 of the base member; compare the distance of offset A in FIG. 10 with the distance of offset B in FIG. 11.

Adjustment of the offset distance is achieved by the present invention through the provision of a radially opening window 160 and an adjustment arm 162 which projects through the window and screws into the eccentric 154.

In order to initially secure the adjustment arm 162 in a given position a retaining collar 164, having a plurality of slots 166 in a longitudinal rim thereof, is mounted about the base member 140. Mounting is achieved by a plurality of threaded rods 168 which extend through corresponding longitudinal slots 170 in the collar 164. The rods 168 thread into corresponding radial openings, such as 172, in the base member 140 and thus permit the retaining collar 164 to axially slide along the collar while relative rotation is prevented.

The inner periphery of the collar is fashioned with a radial stop ledge 174 which operably abuts against the enlarged head portion 142 of the base member.

The stop ledge 174 of the retaining collar 164 is normally biased against the head portion 142 by the provision of axially extending compression springs 176. In this posture a notch 166 of the retaining ring will fit around the adjustment arm 162 to maintain the eccentric 154 in a desired position.

When it is desirable to adjust the position of the eccentric and thus the amplitude of the orbital, break-up motion of the apparatus, the collar 164 is depressed against the compression springs 176 and the arm 162 is rotated to a desired position. The retaining ring is then released and a slot 166 re-engages the adjustment arm; compare the position of adjustment arm 162 in FIGS. 10 and 11. In order to gauge the degree of adjustment a second collar 180 is mounted about the upper end of collar 164 and is imprinted with numerical indicia 182 corresponding to slot, and thus adjustment, locations on the retaining collar 164.

In order to tightly secure the eccentric 154 in a position of adjustment, in addition to arm 162 and collar 164, the head portion 142 of the base member 140 is fashioned with a threaded aperature 184 which radially intersects axis 150. The eccentric is fashioned with a peripheral recess 186 and a set screw 188 extends through the aperature to releasably engage the recess 186 and retain the eccentric in a desired position of adjustment.

In the event it is desired to increase or decrease the amphitude of the units orbital, breakup motion, by offsetting the ball 104 with respect to the central, longitudinal axis of the base 140, the set screw 188 is backed off and the collar 164 depressed against compression springs 176. The adjustment arm 162 is then rotated to a desired numercial station and the retaining collar 164 is released whereby a notch 166 re-engages the adjustment arm 162. The set screw is then tightened down and the adjustment is completed.

ADVANTAGES OF THE INVENTION

After reviewing the foregoing description of a preferred embodiment of the invention, in conjunction with the drawings, it will be appreciated by those skilled in the art that several distinct advantages of the subject polisher-finer apparatus are obtained.

Without attempting to set forth all of the desirable features of the instant invention, at least some of the major advantages include the unique orbital, break-up motion of both the lapping tool and the lens being finished.

The dual, orbital, break-up motion enhances the relative movement between the lens and lapping tool to increase the speed of the lens finishing operation without imparting a regular or uniform motion factor which might tend to permit fine ridges, grooves or the like to form during the finishing process.

The adjustment assembly permits the ball of the universal ball joint unit to be selectively offset to facilely adjust the amphitude of the orbital, break-up motion of the lapping tool and lens.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention.

What is claimed is:

1. An apparatus for finishing a surface of a lens comprising:

a frame;

first means connected to said frame for providing an orbital, break-up motion to a lapping tool having a polishing surface of a selected base curve and cross curve, said first means including, a first shaft having an upper end and a lower end;

means connected to the lower end of said first shaft for rotating said shaft about its axis;

means for moving the axis of said first shaft in a circular path such that the path of motion of said axis lies upon the exterior surface of an imaginary cylinder;

a second shaft having an upper end, for operable connection to the lapping tool, and a lower end;

universal ball joint means for connecting the upper end of said first shaft with the lower end of said second shaft; and generally horizontal gimbal means mounted upon said frame for supporting said second shaft intermediate the ends thereof wherein rotation of said first shaft and movement of the axis thereof in a circular path imparts an orbital, break-up motion to the gimbal mounted lapping tool;

second means connected to said frame for providing an orbital, break-up motion to a lens of common base curve and cross curve with the lapping tool, said second means including a first shaft having an upper end and a lower end;

means connected to the upper end of said first shaft for rotating said shaft about its axis;

means for moving the axis of said first shaft in a circular path such that the path of motion of said axis lies upon the exterior surface of an imaginary cylinder;

a second shaft having a lower end, for operable connection to the lens, and an upper end;

universal ball joint means for connecting the lower end of said first shaft with the upper end of said second shaft; and generally horizontal gimbal means mounted upon said frame for supporting said second shaft intermediate the ends thereof wherein rotation of said first shaft and movement of the axis thereof in a circular path imparts an orbital, break-up motion to the gimbal mounted lens;

means connected to said frame for biasing the lens into engagement with the lapping tool;

first adjustment means connected to said first means for providing an orbital, break-up motion to the lapping tool for adjusting the amplitude of the orbital motion of the lapping tool; and second adjustment means connected to said second means for providing an orbital, break-up motion to the lens, for adjusting the amplitude of the orbital, break-up motion of the lens, whereby a combination of adjustable, orbital, break-up movements are provided between the lens surface and the lapping tool surface, said second adjustment means including a base means for connection, at one end, with the lower end of said first shaft of said second means for providing an orbital, break-up motion to the lens;

eccentric means rotatably mounted within the other end of said base means for connection, said eccentric means having a central longitudinal axis offset with respect to a central longitudinal axis of said base means;

ball means mounted at one end upon said eccentric means and at the other end within said universal ball joint means, said ball means being mounted upon said eccentric means in a position radially offset from the central longitudinal axis of said eccentric means; and means for rotationally adjusting said eccentric means about its central longitudinal axis for selectively varying the distance said ball means is radially offset from the central longitudinal axis of said base means; and means for locking said eccentric means in an adjusted position following rotational adjustment of said eccentric means.

2. An apparatus for finishing a surface of a lens comprising:

a frame;

first means connected to said frame for providing an orbital, break-up motion to a lapping tool having a polishing surface of a selected base curve and cross curve, said first means including, a first shaft having an upper end and a lower end;

means connected to the lower end of said first shaft for rotating said shaft about its axis;

means for moving the axis of said first shaft in a circular path such that the path of motion of said axis lies upon the exterior surface of an imaginary cylinder;

a second shaft having an upper end, for operable connection to the lapping tool, and a lower end;

universal ball joint means for connecting the upper end of said first shaft with the lower end of said second shaft; and generally horizontal gimbal means mounted upon said frame for supporting said second shaft intermediate the ends thereof wherein rotation of said first shaft and movement of the axis thereof in a circular path imparts an orbital, break-up motion to the gimbal mounted lapping tool;

second means connected to said frame for providing an orbital, break-up motion to a lens of common base curve and cross curve with the lapping tool, said second means including a first shaft having an upper end and a lower end;

means connected to the upper end of said first shaft for rotating said shaft about its axis;

means for moving the axis of said first shaft in a circular path such that the path of motion of said axis lies upon the exterior surface of an imaginary cylinder;

a second shaft having a lower end, for operable connection to the lens, and an upper end;

universal ball joint means for connecting the lower end of said first shaft with the upper end of said second shaft; and generally horizontal gimbal means mounted upon said frame for supporting said second shaft intermediate the ends thereof wherein rotation of said first shaft and movement of the axis thereof in a circular path imparts an orbital, break-up motion to the gimbal mounted lens;

means connected to said frame for biasing the lens into engagement with the lapping tool;

first adjustment means connected to said first means for providing an orbital, break-up motion to the lapping tool for adjusting the amplitude of the orbital motion of the lapping tool; and second adjustment means connected to said second means for providing an orbital, break-up motion to the lens, for adjusting the amplitude of the orbital, break-up motion of the lens, whereby a combination of adjustable, orbital, break-up movements are provided between the lens surface and the lapping tool surface, said second adjustment means including base means for connection, at one end, with the lower end of said first shaft of said second means for providing an orbital, break-up motion to the lens;

eccentric means connected to the other end of said base means for connection, said eccentric means having a central longitudinal axis offset with respect to a central longitudinal axis of said base means;

ball means mounted at one end upon said eccentric means and at the other end within said universal ball joint means, said ball means being mounted upon said eccentric means in a position radially offset from the central longitudinal axis of said eccentric means; and means for rotationally adjusting said eccentric means about its central longitudinal axis for selectively varying the distance said ball means is radially offset from the central longitudinal axis of said base means, said means for adjusting including collar means mounted about said base means with the lower end of said first shaft; and arm means connected to said eccentric means for rotating said eccentric means with respect to said connection means and being selectively engageable with said collar means to releasably hold said eccentric means in a selected position of rotational adjustment.

3. An apparatus for finishing a surface of a lens as defined in claim 2 wherein:

said collar means is provided with a plurality of slots within one end thereof and is mounted for selective reciprocation about said base means; and means for biasing said slots into engagement with said arm means wherein said collar means may be reciprocated against said spring bias and away from said arm means to free said arm means to adjust said eccentric means and then biased back into securing engagement with said arm means.

4. An apparatus for finishing a surface of a lens as defined in claim 3 and further comprising:

means for selectively securing the rotational position of said eccentric means with respect to said base means for connection.

5. An apparatus for adjusting the amplitude of orbital, break-up motion of a lens finishing machine having at least a first assembly means including a rotating and orbiting first shaft and a gimbal mounted second shaft which operably provides relative motion between a lens and a lens finishing tool wherein said apparatus for adjusting comprises:

base means for connection, at one end, to a free end of the first shaft for rotating and orbiting therewith;

eccentric means rotably mounted within the other end of said base means and having a central longitudinal axis offset with respect to a central longitudinal axis of said base means;

ball means mounted upon said eccentric means for universal connection to said gimbal mounted second shaft, said ball means being mounted in a position radially offset from the central longitudinal axis of said eccentric means;

means for rotationally adjusting said eccentric means about its central longitudinal axis for selectively varying the distance said ball means is radially offset from the central longitudinal axis of said base means; and means for locking said eccentric means in an adjusted position following rotational adjustment of said eccentric means.

6. An apparatus for adjusting the amplitude of orbital, break-up motion of a lens finishing machine as defined in claim 5 wherein said means for rotationally adjusting said eccentric means comprises collar means mounted about said base means; and arm means connected to said eccentric means for rotating said eccentric means with respect to said base means and selectively engageable with said collar means to releasably hold said eccentric means in a given position of rotational adjustment.

7. An apparatus for adjusting the amplitude of orbital, break-up motion of a lens finishing machine as defined in claim 5 wherein:

said base means comprises a generally solid cylindrical member having a radially enlarged head portion; and said eccentric means comprises a cylindrical member mounted within a cylindrical recess radially offset from the central longitudinal axis of said enlarged head portion.

8. An apparatus for adjusting the amplitude of orbital break-up motion of a lens finishing machine as defined in claim 7 wherein:

said radially enlarged head portion is fashioned with a radially opening window exposing the interior of said cylindrical recess; and said means for rotationally adjusting includes arm means radially extending through said window and into engagement with said eccentric means positioned within cylindrical recess.

9. An apparatus for adjusting the amplitude of orbital break-up motion of a lens finishing machine as defined in claim 8 wherein said means for rotationally adjusting further comprises:

collar means mounted about said generally solid cylindrical member and having a plurality of notches in one end thereof;

means for permitting said collar means to translate relative to said generally solid cylindrical member while not permitting relative rotation with respect thereto; and means for biasing said collar means and a given one of said slots into engagement with with said arm means, wherein axial translation of said collar means will operably serve to free said arm means for rotating said eccentric means and varying the radial offset of said ball means with respect to the central longitudinal axis of said generally solid cylindrical base member.

10. An apparatus for adjusting the amplitude of orbital break-up motion of a lens finishing machine as defined in claim 9 and further comprising:

a peripheral recess fashioned within said eccentric means; and set screw means extending through a lateral location of said enlarged head portion of said base means for engagement with said peripheral recess to selectively lock said eccentric means with respect to said solid cylindrical base member.

11. An apparatus for adjusting the amplitude of orbital, break-up motion of a lens finishing machine having at least a first assembly means including a rotating and orbitating first shaft and a gimbal mounted second shaft which operably provides relative motion between a lens and a lens finishing tool wherein said apparatus for adjusting comprises:

base means for connection, at one end, to a free end of the first shaft for rotating and orbiting therewith;

eccentric means connected to the other end of said base means and having a central longitudinal axis offset with respect to a central longitudinal axis of said base means;

ball means mounted upon said eccentric means for for universal connection to said gimbal mounted second shaft, said ball means being mounted in a position radially offset from the central longitudinal axis of said eccentric means; and means for rotationally adjusting said eccentric means about its central longitudinal axis for selectively varying the distance said ball means is radially offset from the central longitudinal axis of said base means, said means for rotationally adjusting comprising, collar means mounted about said base means; and arm means connected to said eccentric means for rotating said eccentric means with respect to said base means and selectively engageable with said collar means to releasably hold said eccentric means in a given position of rotational adjustment.

12. An apparatus for adjusting the amplitude of orbital, break-up motion of a lens finishing machine as defined in claim 11 wherein:

said collar means is provided with a plurality of slots within one end thereof and is mounted for selective reciprication upon said base means; and means for biasing said collar slots into engagement with said arm means wherein said collar means may be reciprocated against said spring bias and away from said arm means to free said arm means for adjusting said eccentric means and upon adjustment biasing said collar means into securing engagement with said arm means.

13. An apparatus for adjusting the amplitude of orbital, break-up motion of a lens finishing machine as defined in claim 12 and further comprising:

second means for selectively securing the rotational position of said eccentric means with respect to said base means.

* * * * *